US005313767A

United States Patent [19]

Gentile

[11] Patent Number: 5,313,767

[45] Date of Patent: May 24, 1994

[54] MULTIPLE PACKAGE FORMING AND FILLING MACHINE

[76] Inventor: Aliseo Gentile, 8011 Schneider, Manchester, Mich. 48158

[21] Appl. No.: 865,983

[22] Filed: Apr. 9, 1992

[51] Int. Cl.[5] ..... B65B 7/06; B65B 43/08

[52] U.S. Cl. ..... 53/456; 53/469; 53/481; 53/563; 53/374.8; 493/133; 493/174

[58] Field of Search ..... 53/131.4, 284.7, 455, 53/456, 469, 473, 479, 481, 553, 548, 562, 563, 575, 578, 374.8; 493/174, 167, 133

[56] References Cited

U.S. PATENT DOCUMENTS

| | | | |
|---|---|---|---|
| 2,754,644 | 7/1956 | Vergobbi et al. | 53/562 X |
| 3,306,002 | 2/1967 | Vogt | 53/456 |
| 3,382,644 | 5/1968 | Vogt | 53/455 |
| 3,602,108 | 8/1971 | Vuilleumier | 493/167 |
| 3,619,966 | 11/1971 | Goldsberry | 53/131.4 X |
| 4,252,052 | 2/1981 | Meyers et al. | 493/177 X |
| 4,631,901 | 12/1986 | Chung et al. | 53/563 X |
| 4,669,253 | 6/1987 | Shavit | 53/455 |
| 4,674,266 | 6/1987 | Araki | 53/374.8 |
| 4,856,261 | 8/1989 | Hackett et al. | 53/469 |

*Primary Examiner*—John Sipos
*Assistant Examiner*—Linda B. Johnson
*Attorney, Agent, or Firm*—James M. Deimen

[57] ABSTRACT

A machine for and a step by step method of forming packages or containers from blanks, heat sealing the sides of the packages and depositing the packages in fixtures, retaining the packages in fixtures during dosing of the packages with product, heat sealing the tops of the packages and ejecting the packages from the fixtures. The sides of a newly formed package are heat sealed through apertures in the forming die before the package is placed in the fixture. Once placed in the fixture at the forming station, the package remains in the fixture during the filling or dosing of product at the filling station and as indexed into the top sealing station. At the top sealing station the filled package is partially elevated from the fixture to expose the entire top of the package for heat sealing.

20 Claims, 8 Drawing Sheets

MULTIPLE PACKAGE FORMING AND FILLING MACHINE

BACKGROUND OF THE INVENTION

The field of the invention pertains to machines that automatically form packages from flat blanks, fill the packages with a liquid or highly viscous material, seal the package and discharge the sealed packages for visual inspection. In particular, the invention pertains to the formation of packages from laminated and coated cardboard blanks to produce a complete sealed and sufficiently sterile enclosure for food items, the packages incorporating integral tear-off tops.

Examples of the packages to which the machines are intended are disclosed in U.S. Pat. No. 4,717,046 and German invention document DE 3143671 A1 wherein a separable tongue or top may be torn off to provide the dispensing outlet for the package, however, the disclosure below is not limited to the particular packages disclosed in these publications.

As a further example reference is made to the package with a replaceable tear-off top disclosed in applicant's pending U.S. patent application Ser. No. 07/705,354 wherein laminated flat blanks are formed into packages. In this disclosure the tear-off top is configured and sealed in a manner that permits the top to be replaced over the dispensing outlet after it is torn off.

U.S. Pat. No. 3,382,644 illustrates a bag forming and filling machine. In this machine the bags or packages after forming on a separate apparatus are raised on fixtures to insert nozzles of the filling apparatus into the packages and the packages are filled before the packages are again lowered. Belgian invention publication No. 547082 discloses a package forming and filling sequence wherein the packages are formed by folding a blank up around an upper mandrel. The package rests on a second mandrel through a side sealing station and a filling station, the upper mandrel having been withdrawn to permit filling. The open top formed packages are filled from hoppers that travel with the packages. The hoppers have filling tubes depending therefrom which enter the packages during the filling operation.

Belgian invention publication No. 538036 discloses the use of an upper former or mandrel that drives a blank down into a die. As the bottom portion of the blank is driven down into the die and the package sides partially folded up toward the upper former, a lower former or mandrel moves up into the die to meet the package bottom. The two formers then proceed downward through the die to form the package. Below the die the package proceeds between rotating side sealers and the formers retract allowing the side sealed package to be blown into a chute as it drops from the side sealers.

The machine disclosed in U.S. Pat. No. 4,669,253 forms a package similar to the Belgian disclosures, however, this disclosure provides two significant differences. Firstly, the bottom forming surfaces of the upper and lower mandrel are complementary and the edges of these surfaces register with the upper edges of the die cavity to form the package sidewalls by defining pronounced boundaries between the clamped bottom portion of the package blank and the adjacent outer portions of the package blank. To accomplish these pronounced boundaries, the curvature of the upper edges of the die cavity matches the curvature of the edges of the complementary former surfaces. In the forming cycle the formers come together at exactly the top edge of the die cavity with the package blank therebetween before descending through the die cavity.

Secondly, in U.S. Pat. No. 4,669,253 the package blank is driven through the die and into a fixture. The fixture is indexed from station to station for sealing the package sides, filling the package and top sealing the package. The package is raised from the fixture for side sealing and again raised from the fixture for filling the package. The package is pushed through the fixture and supported from the bottom for top sealing and discharge from the machine below the fixture.

U.S. Pat. No. 4,252,052 discloses a similar package forming machine, however, this machine differs in three significant ways. First, this machine lacks a lower former or mandrel. Second, the lower die comprises two opposed downwardly curving plates that are completely open to allow the package edges to remain apart. Third, the package edges are air heated to activate the sealant before the edges are clamped together. The air heater is inserted between the package edges before the edges are clamped together.

The formation of pouch type packages from coated paper board blanks requires careful and accurate folding and sealing. The open package must then be transported for dosing or filling with product and finally positioned for sealing of the filled package. With a view toward avoiding unnecessary movement of the package through the forming, filling and sealing cycle, applicant has developed the machine and method disclosed below.

SUMMARY OF THE INVENTION

The invention comprises a step by step method of forming packages or containers from blanks, heat sealing the sides of the packages and depositing the packages in fixtures, retaining the packages in the fixtures during dosing of the packages with product, heat sealing the tops of the packages and ejecting the packages from the fixtures. The formed packages remain in the fixtures from first placement therein until filled and completely sealed thereby greatly simplifying a complex package forming, filling and sealing procedure on an automatic machine.

In forming the package, a blank is placed on a tray above a forming die and positioned with the center of the blank spaced above the die and below an upper reciprocable mandrel or former. A second mandrel or former ascends to meet the center of the blank above the die and together with the descent of the upper mandrel draw the blank down into the die opening. The mandrels drive the blank center down into the die causing the blank sides to fold upwardly.

With the blank drawn down fully into the die, the mandrels hesitate momentarily as heated elements enter vertical apertures in the sides of the die and heat seal the sides of the blank together to form an open top package.

The mandrels then resume the downward movement through the die to deposit the packages in a fixture. Once deposited in a fixture, the package remains in the fixture and is indexed from station to station until filled and the top sealed.

The filling station bottom fills the open packages by dosing each package with a measured amount of liquid or paste like product. With simultaneous dosing of a plurality of packages in a plurality of fixtures each package is fed by an adjustable stroke bellows pump. Normally all of the bellows pumps will be adjusted for equal dosages, however, the machine is capable of simultaneously filling differing amounts into packages in separate fixtures. A single hopper feeds a manifold in turn directly connected with tubes to the bellows pumps. The bellows pumps in turn are connected with tubes to filling tubes that bottom feed the packages.

Although applicable to almost any liquid product from the thin and watery to very thick viscous pastes, the adjustable dosing apparatus is particularly suited to products that must be packaged essentially contamination free such as food items, creams and lotions, and medicinal items. The dosing apparatus and entire machine is particularly suited for clean room operation.

Of particular advantage, the hopper and manifold merely rest in the machine on brackets from which they can be easily lifted and disassembled for cleaning. The flexible connecting tubes are smooth walled plastic and the filling tubes smooth walled metal tubes that merely rest in a vertically movable carrier. As with the hopper and manifold, the tubes can be disassembled for cleaning and reassembled without tools. The bellows pumps with check valves likewise can be removed from the machine without tools, however, because the bellows and check valves can not so easily be thoroughly cleaned, they are made from inexpensive plastic and are discarded to prevent any contamination with product changes.

Since the dosing apparatus may be used for products sensitive to degradation with time when exposed to the environment, ease of disassembly, cleaning and reassembly is paramount to the reduction of downtime. Product never contacts any complex moving mechanical parts and the dosing apparatus may be cleaned as often as necessary. The machine with this particular dosing apparatus is particularly suitable for contract packages who frequently change from one product run to a different product for the next run. Under such circumstances prevention of contamination by a previous product is paramount.

The open but filled package is indexed to a top sealing or closure station where an ejector or anvil raises the package in the fixture to expose the top for heat sealing. Upon heat sealing the ejector further raises the package from the fixture into an unloading station wherein the package slides down a chute in full view of an operator for inspection purposes prior to discharge from the machine.

The machine is capable of high production rates with short downtimes for cleaning and change of product. The package, upon being formed follows a simpler less complicated path than the nearest previous similar machines and therefore presents fewer mechanical problems with off size blanks and packages.

DESCRIPTION OF THE PREFERRED EMBODIMENT

Figure 1:
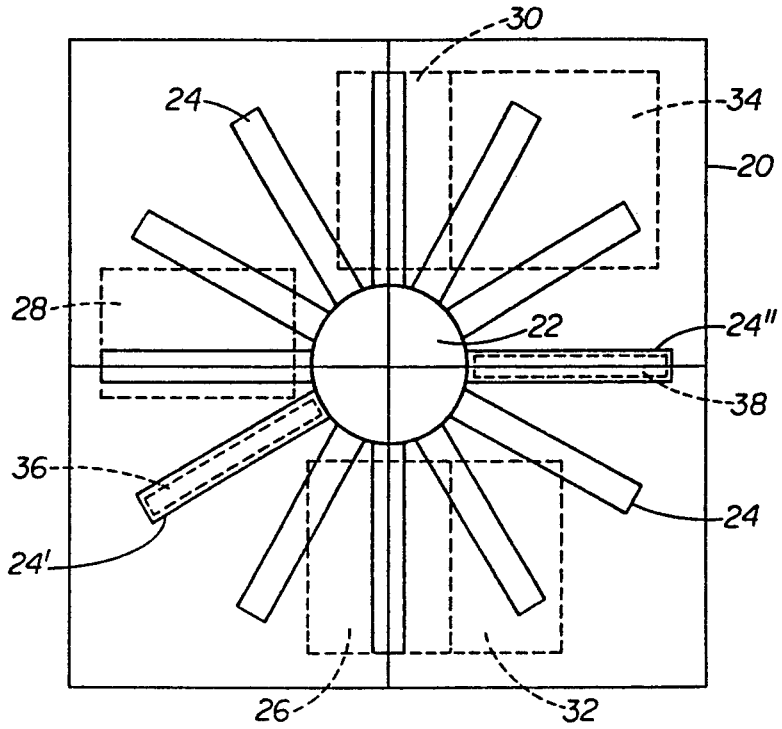
FIG. 1 is a schematic plan view of the stations for the machine.

In FIG. 1 as shown the floor plan of the packaging and filling machine is a square 20. Within the plan is a motor driven index drive turntable 22 having twelve arms 24 extending radially therefrom. Each of the twelve arms 24 supports a plurality of package retaining fixtures disclosed below. At each index cycle of the index drive 22 the arms 24 move one-twelfth of a full rotation.

Above the rotating arms 24 and fixtures are located the three principal stations, in particular, the package forming station 26, the filling station 28 and the final sealing station 30. In addition, a loading station 32 for package blanks and an unloading station 34 for the inspection of filled packages adjoin the forming station 26 and the final sealing station 30 respectively. Two separate sensor stations are included at locations separate from those above. The sensor station at 36 senses for formed open packages in each fixture location before the arm 24' rotates into the filling station 28. The sensor station at 38 senses for empty fixtures before the arm 24'' rotates into the forming station 26.

Figures 2, 2A:
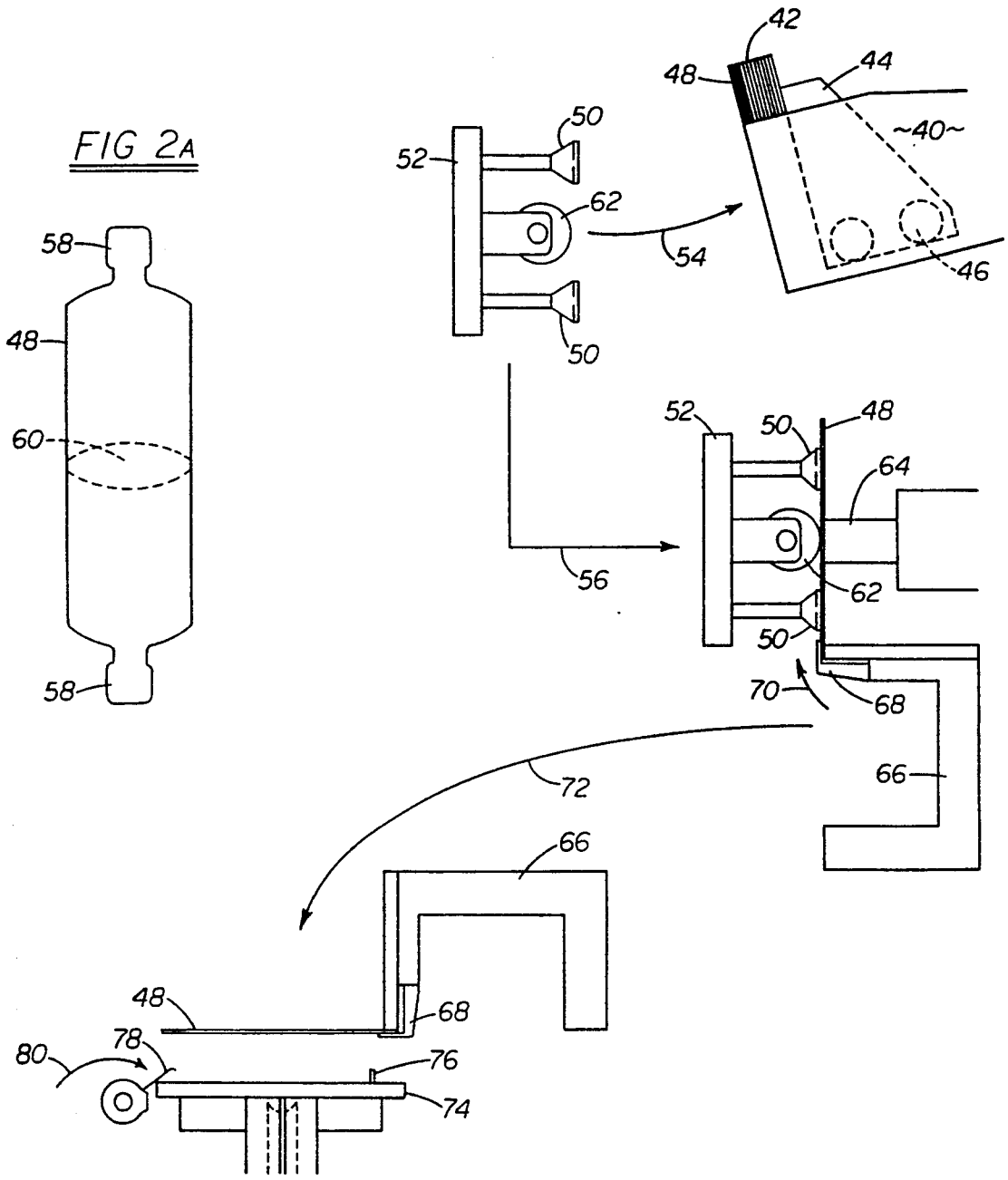
FIG. 2 schematically illustrates the movement of flat package blanks from the loading station into the forming station.
FIG. 2*a* illustrates the shape of a flat package blank.

In FIG. 2 the loading mechanism and sequence is shown comprising a tilted chute 40 stacked with a quantity of package blanks 42. Within the chute 40 is a weight 44 on rollers 46 that rests against the stack of blanks 42 so that they move down the chute 40 in proper orientation for feeding to the forming station 26. The forwardmost blank 48 is retained at the end of the chute by small tabs or edges on the end of the chute 40 such that blank 48 can be grasped by suction cups 50 on the grabber 52.

The grabber 52 moves over and up as indicated by arrow 54, grasps the blank 48 with the suction cups 50 and then retracts back, down and horizontally to the right as indicated by arrow 56. FIG. 2*a* shows the shape of the blanks 48 with tabs 58 at each end that eventually form the dispensing outlet and tear-off top of the package. The central portion of the blank 48 as indicated at 60 eventually forms the bottom of the package.

Returning to FIG. 2 the grabber 52 includes an embossing or imprinting wheel 62 which with air cylinder and piston rod 64 causes a serial number or identification number to be added to the central portion 60 of the blank 48. With the blank in this position a rotator 66 having a gripper 68 grips the blank 48 and retains the blank in a vertical position as the grabber 52 retracts to the left and upwardly. The gripper 68 is rotatable into gripping position as indicated by the arrow 70 and grasps the lower one of the tabs 58 on the blank 48.

With the grabber 52 cleared, the rotator 66 moves with the blank 48 as indicated by arrow 72 to place the blank 48 horizontally above the forming tray 74 in the forming station 26. The blank 48 is then lowered onto the tray 74, the gripper 68 disengaged from the blank 48 and the rotator 66 retracted to its former position. Pins 76 are located on the tray 74 to either side of the tab 58 that had been in the gripper 68. At the other end of the blank 48 a pair of wires 78 rotatable as indicated by arrow 80 engage the blank 48 to either side of tab 58 and push the blank 48 into engagement with the pins 76 thereby properly placing the blank 48 in the tray 74 for the package forming operation.

Figure 3:
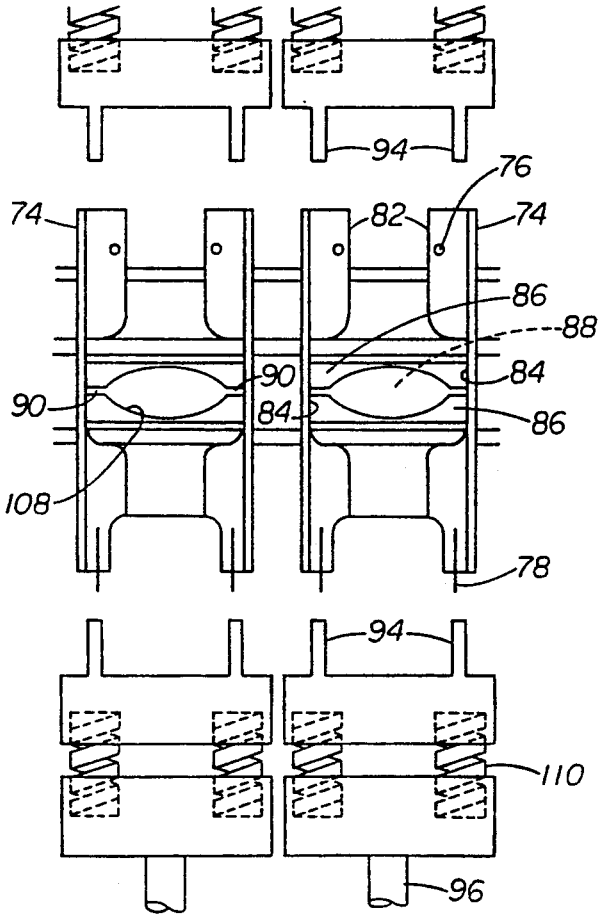
FIG. 3 is a schematic top view of the lower portion of a pair of package forming units.
Figure 4:
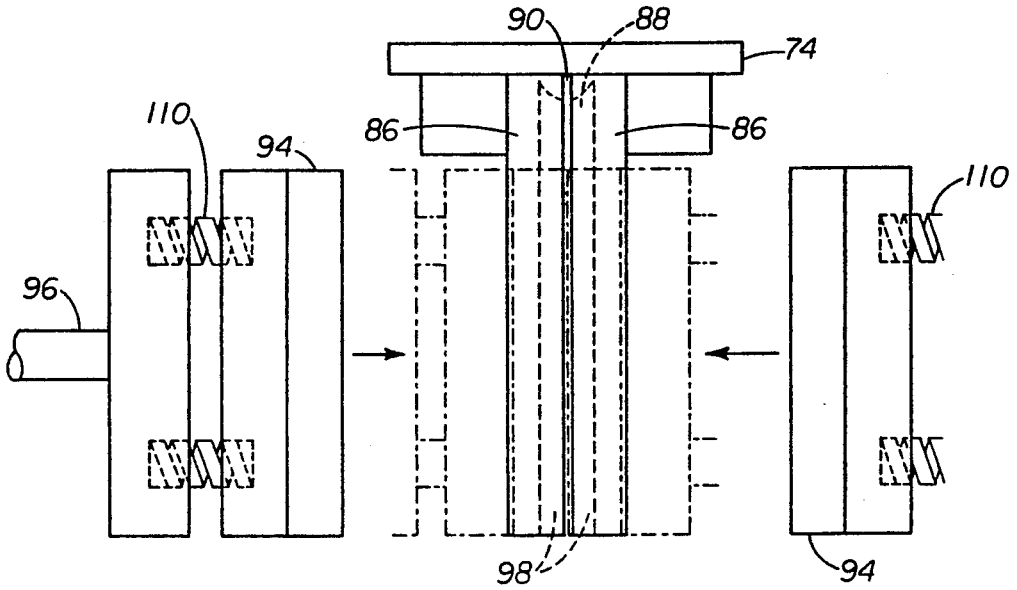
FIG. 4 is a schematic side view of the lower portion of a package forming unit.

In FIGS. 3, 4, 5 and 6 the package forming and fixture loading process occurs at station 26. In FIGS. 3 and 4 two parallel trays 74 are illustrated with the pins 76 and wires 78. The tray 74 is generally open at 82 to provide clearance for the gripper 68 as the blank 48 is placed on the tray. And, the tray 74 bottom is fully open transversely at the center 84 to provide an aperture leading to the forming die 86 therebelow. The die cavity 88 is generally oblong with slots 90 to each side. At the top the die 86 is generally curved in a smooth manner to guide the blank 48 into the die. Beneath each tray 74 and upper portion of the die 86 are dual opposed heated sealers 94 that are actuated by air cylinders 96 to seal the edges of the package. The sealers 94 enter and retract through slots 98 in the die 86 as shown in FIG. 5 to squeeze the edges of the package together and seal them.

In FIG. 5 the sequence of forming the package and placing the package in a fixture is shown. In FIG. 5*a* the blank 48 is lying in the tray 74 spaced above the die cavity 88. The lower mandrel 100 is ascending and the upper mandrel 102 is descending. With the lower mandrel 100 at the top of its stroke partially above the top of the die cavity and just below the blank 48 on the tray 74, the upper mandrel 102 forces the center 60 of the blank 48 down against the top 104 of the lower mandrel 100. The bottom 60 of the package is formed by the complementary bottom 105 of the upper mandrel 102 against the top 104 of the lower mandrel. With the bottom 60 of the package trapped between the mandrels 100 and 102, the mandrels descend into the die cavity 88 drawing the blank 48 with them as shown in FIG. 5*b*. The sides 106 of the package are driven upwardly against the upper mandrel 102 by the action of the mandrels 100 and 102 in driving the bottom 60 of the package down into the die cavity 88 in conjunction with the smoothly curved upper edges 108 of the die cavity 88. The sides of the lower mandrel 102 are partially flattened at 103. The two mandrels 100 and 102 may suitably be actuated by air cylinders (not shown).

Figure 5A:
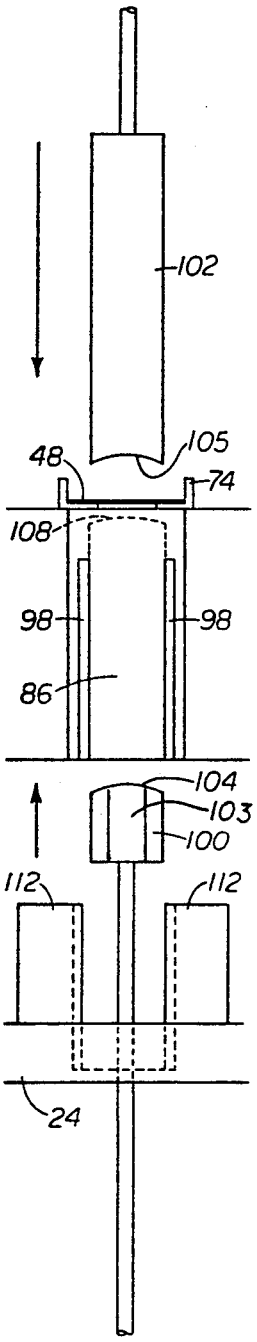
FIGS. 5*a*, 5*b*, 5*c* and 5*d* illustrate schematically the package forming sequence at the forming station.
Figure 5B:
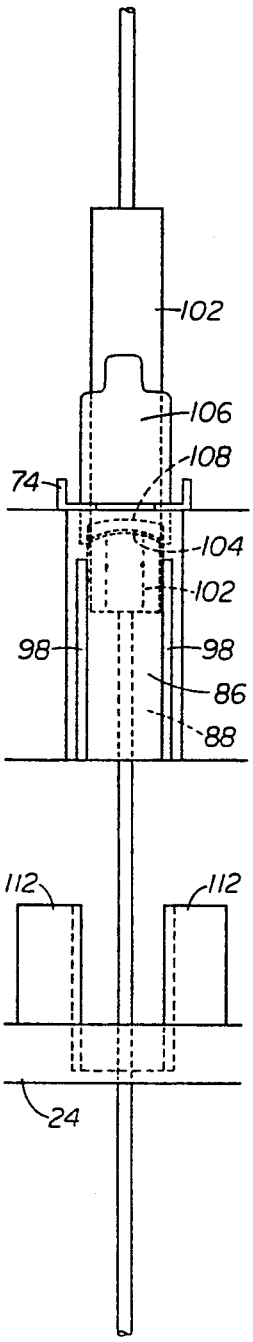
Figure 5C:
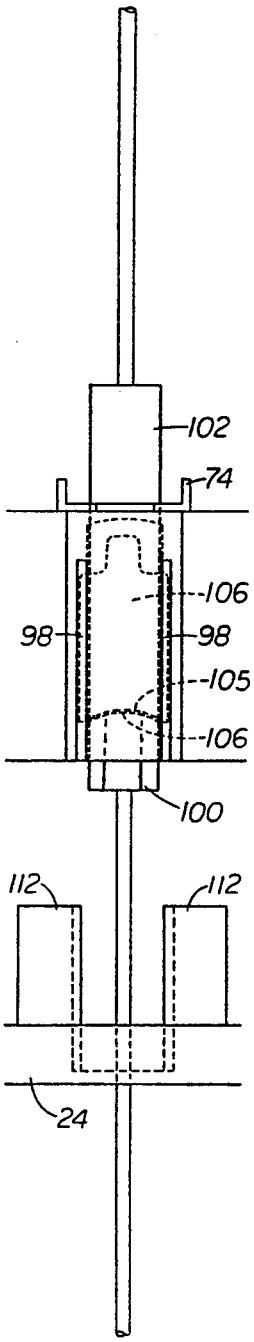

The two mandrels 100 and 102 carry the package blank 48 down fully into the die cavity 88 to the hesitation position shown in FIG. 5*c*. The edges of the package are thereby aligned with the slots 98 whereupon the heat sealers 94 are actuated to enter the slots 98 and heat seal the package edges together. The heat sealers 94 are mounted on springs 110 to self align and thereby provide a more even seal on the package edges.

Figure 5D:
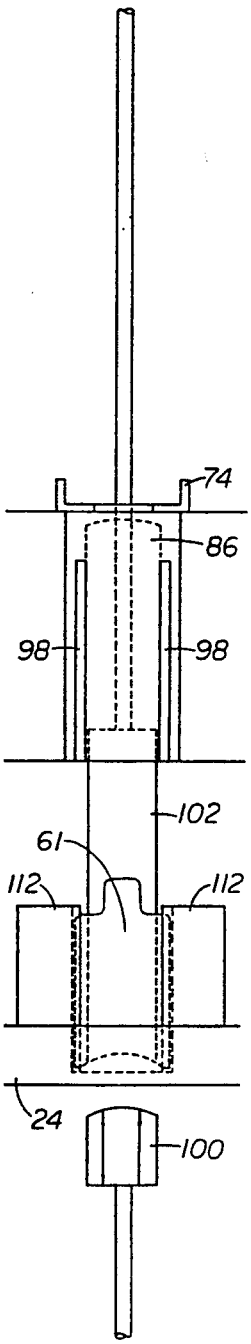

Upon retraction of the heat sealers 94 the downward motion of the mandrels 100 and 102 resumes until the package, now denoted 61, is deposited in the fixture 112 atop an arm 24 as shown in FIG. 5*d*. The lower mandrel 100 further descends as shown to clear the arm 24. With the package 61 deposited in the fixture 112, the upper mandrel 102 ascends to clear the arm 24, package 61 and fixture 112 and further to clear the tray 74 and rotating motion of the blank 48 shown in FIG. 2.

Figure 6:
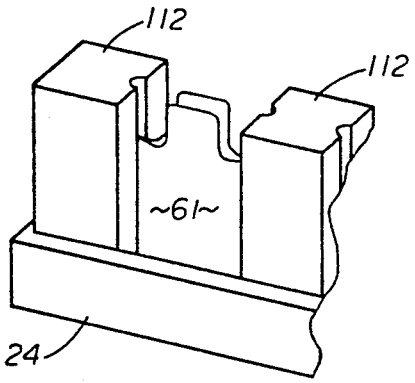
FIG. 6 is a partial perspective view of a fixture and package.

It is important to note that the package 61 once deposited as shown in FIG. 5*d* and FIG. 6 remains in the fixture 112 through the filling station 28 and into the sealing station 30. It is also important to note that while described above generally in terms of one package forming unit and loading unit, in most embodiments a plurality of units at each station are employed so that several identical operations are produced in parallel at each station. In the prototype machine seven fixtures 112 are mounted in-line on each arm 24. At each station including the load 32 and unload 34 stations seven operations proceed in parallel.

Figure 7:
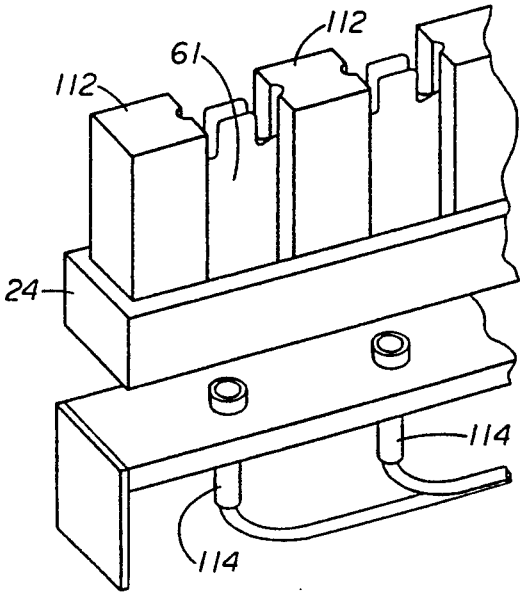
FIG. 7 is a partial perspective view of the fixture arm at an intermediate sensing station.

In FIG. 7 intermediate sensing station 36 comprises a plurality of sensors 114 that each check for a package 61 in the fixture 112 thereabove. In the event that a package is absent, the subsequent filling unit at station 28 for that particular fixture is temporarily disabled to prevent spillage, however, the machine continues to operate. A similar plurality of sensors 114 are located at sensor station 38, however, the fixtures are normally empty at this portion of the cycle. In the event that a package was not discharged at the final sealing station 30, a sensor 114 at station 38 stops the machine until an operator can empty the fixture.

Figure 8:
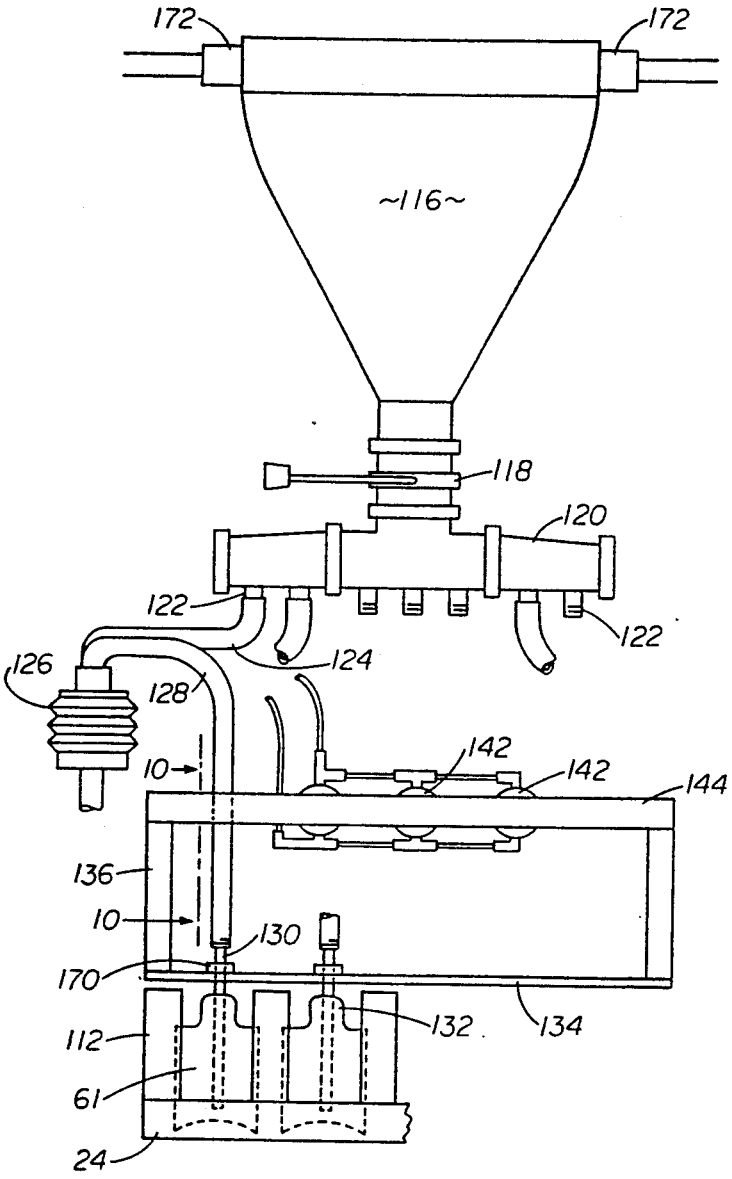
FIG. 8 is a schematic view of the filling apparatus at the filling station with a filling tube inserted in a package.

Turning to the filling station 28 illustrated in FIG. 8 is a hopper 116 for the supply of filling product or material to be supplied to the individual packages 61 therebelow. The hopper 116 is connected with a circumferential quick disconnect clamp 118 to a manifold 120 having a plurality of orifice tubes 122. The orifice tubes 122 in turn are each connected through plastic tubes 124 to bellows pumps 126. The outlets of the bellows pumps 126 communicate through plastic tubes 128 with filling tubes 130. As shown the filling tubes 130 are fully lowered into the packages 61 through the open tops 132. Only one pumping and filling circuit is shown although as indicated by the number of orifice tubes 122 shown on the manifold 120 seven are intended and seven packages 61 are filled simultaneously.

A squeezing stroke of the bellows pumps 126 causes a measured dose of product to be expelled from the filling tubes 130 into the packages 61 as the filling tubes 130 are raised upwardly. Thus, product is bottom fed to the packages 61. To accomplish the filling stroke, the filling tubes 130 are retained in vertically movable frame member 134 and the lower portions of the tubes 128 grasped in the vertically movable frame 136. Thus, in FIG. 8 a filling tube 130 is shown in its lowermost position and in FIG. 9 in its uppermost position.

Figure 9:
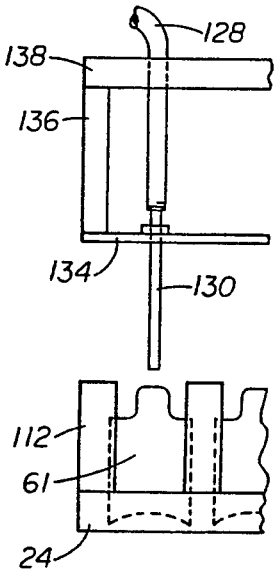
FIG. 9 is a schematic view of the filling nozzle retracted above the package.

As shown in FIGS. 8 and 9 the packages 61 are vertically positioned in the fixtures 112 on the arms 24. In their uppermost position the filling tubes 130 clear the package tops 132 to permit the fixtures 112 on the arm 24 to index out and the next arm 24 with the next set of fixtures 112 and empty packages 61 to index in beneath the filling tubes 130.

Figure 10:
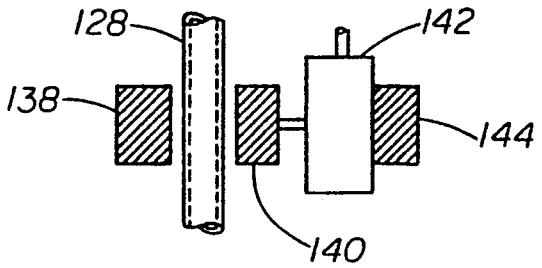
FIG. 10 is a schematic view of the suck back mechanism taken in the direction 10—10 in FIG. 8.

Intermediate the lowermost position and the uppermost position on the upward filling stroke, the bellows pump 126 completes the product expulsion stroke. To control or eliminate drip or creep of excess product from the tips of the filling tubes 130, the plastic tubes 128 are grasped between frame members 138 and 140 as best shown in FIG. 10. Frame member 140 is movable relative to frame member 138 to squeeze shut plastic tubes 128 upon completion of the product expulsion stroke by the bellows pumps 126. A plurality air cylinders 142 are employed to provide even squeezing of all tubes 128 by member 140 thus terminating flow of product. The air cylinders 142 react against frame members 144 and the entire assembly raises and lowers with the filling tubes 130.

With the beginning of the expansion stroke of the bellows pumps 126, the outlet valves within the bellows pumps close sealing the upper ends of the tubes 128. With the tubes 128 thus sealed the air cylinders 142 open the frame members 138 and 140 causing a slight momentary suction or "suck back" in the filling tubes 130 and thereby controlling or preventing drip or creep of product from the tips of the filling tubes 130. Suction is maintained merely by the viscosity and surface tension of the product until the filling tubes 130 are again lowered into empty packages to repeat the filling cycle.

Figure 11:
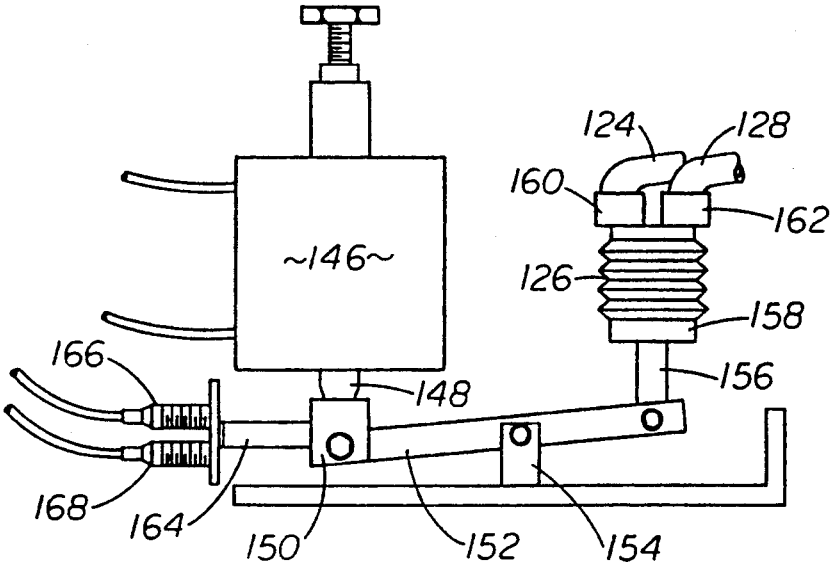
FIG. 11 is a schematic view of the adjustable pumping mechanism for the filling apparatus.

In FIG. 11 the mechanism for actuating a bellows pump 126 comprises an adjustable stroke air cylinder 146 wherein the piston rod 148 engages a lever arm tip 150 and arm 152. The arm 152 rotates about a fulcrum 154 with a pump rod 156 attached at the end opposite the air cylinder 146. Affixed to the upper end of the pump rod 156 is an internally threaded cap 158. The bellows pump 126 base is threaded into the cap 158. Inlet tube 124 and outlet tube 128 are connected to the bellows pump 126 through internal inlet poppet valve 160 and internal outlet poppet valve 162. Thus, the adjustable stroke of the air cylinder piston rod 148 adjusts the stroke of the bellows pump 126 and the quantity of product dispensed. An extension 164 affixed to the lever arm tip 150 reciprocates between a pair of proximity sensors 166 and 168 to sense the operation of the bellows pump 126. These sensors 166 and 168 indicate if no dose of product has been fed to a package. The mechanism illustrated in FIG. 11 is repeated for each of the bellows pumps 126 at filling station 28.

The filling station 28 apparatus is particularly suited to ease of disassembly, cleaning and reassembly of all parts contacted by product. The hopper 116, manifold 120 and clamp 118 are constructed of stainless steel. The tubes 124 and 128 are constructed of a flexible food grade plastic such as polyethylene and internally smooth. The filler tubes 130 are straight smooth walled stainless steel with no internal changes in cross-section. Collars 170 are affixed to the filler tubes 130 to retain the tubes 130 in holes in frame member 134. The plastic tube 124 and 128 connections are sized for frictional engagement with the manifold orifice tubes 122 and the filling tubes 130 as well as with the bellows pump 126 inlet and outlet. The hopper 116 and manifold 120 rest in brackets 172.

Thus, for change of product cleaning the plastic tubes 124 and 128 are slipped off, the hopper 116 and manifold 120 are lifted out of the brackets 172 and disconnected at clamp 118. The bellows pump 126 is unscrewed from the cap 158 and the filling tubes 130 are lifted from the holes in the frame member 134.

The bellows pump 126 and valves 160 and 162, having product contacting areas difficult to clean, are constructed of inexpensive plastics and discarded. The plastic tubes 124 and 128 may be cleaned or discarded as desired and the remaining stainless steel hopper 116, manifold 120 and filling tubes 130 cleaned. No complicated drive, adjusting or sensing devices contact product, therefore they need not be disassembled, cleaned or discarded. Turn-around time for changes in product are greatly decreased in comparison with prior art machines wherein disassembly, cleaning and reassembly require many hours of machine downtime.

Figure 12:
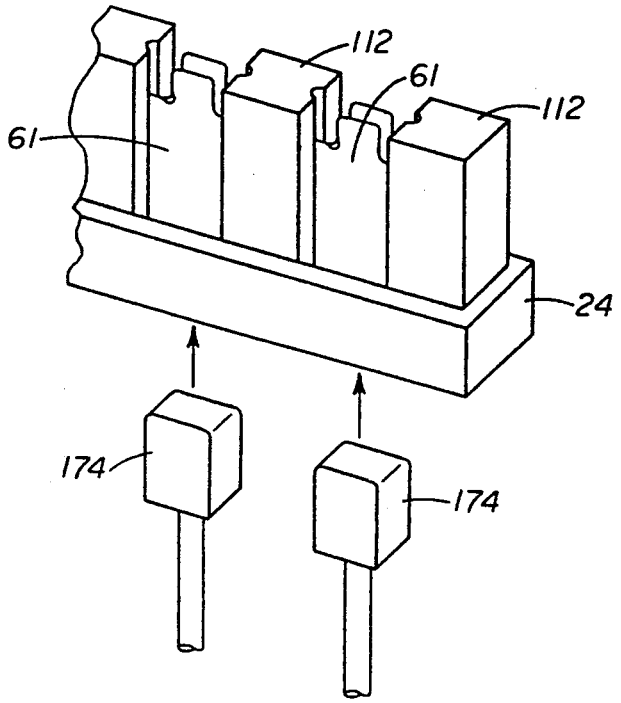
FIG. 12 is a schematic view of the beginning of the package ejection from the fixture at the final sealing station.
Figure 13:
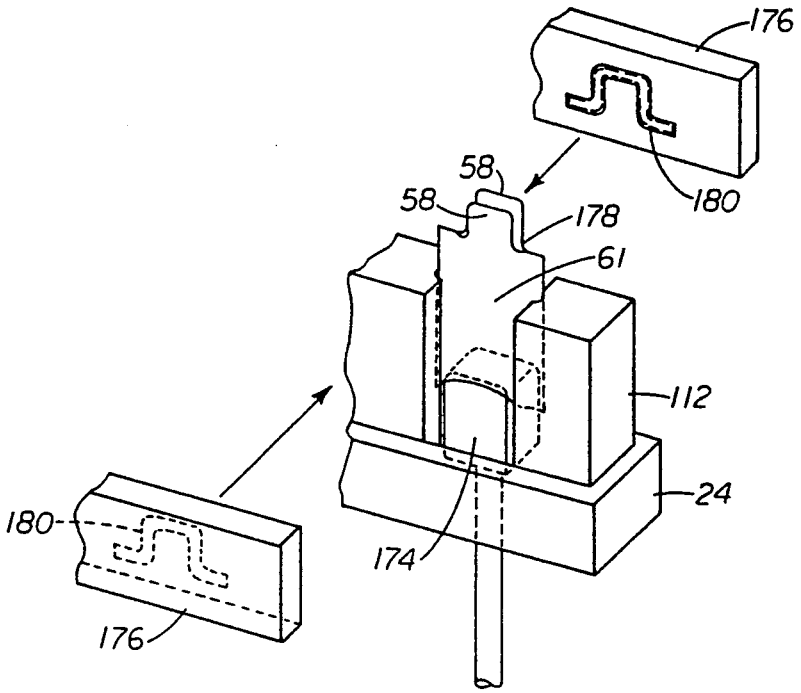
FIG. 13 is a schematic view of the final sealing of the package.

As shown in FIG. 12 in final sealing station 30 each package 61 in a fixture 112 located on an arm 24 is contacted from the bottom by an ascending ejector 174. The ejector 174 moves the package 61 upwardly partially out of the fixture 112 and then hesitates in the position shown in FIG. 13. A pair of heated package sealers 176 clamp the top 178 of the package 61 together to complete the sealed package. As shown the package sealers 176 include shaped squeezing dies 180 to provide a tight bond about the top 178 of the package including sealing the tabs 58 together. Each pair of heated package sealers 176 is driven by a pair of air cylinders (not shown) in the same manner as the heated sealers 94 at station 26.

Figure 15:
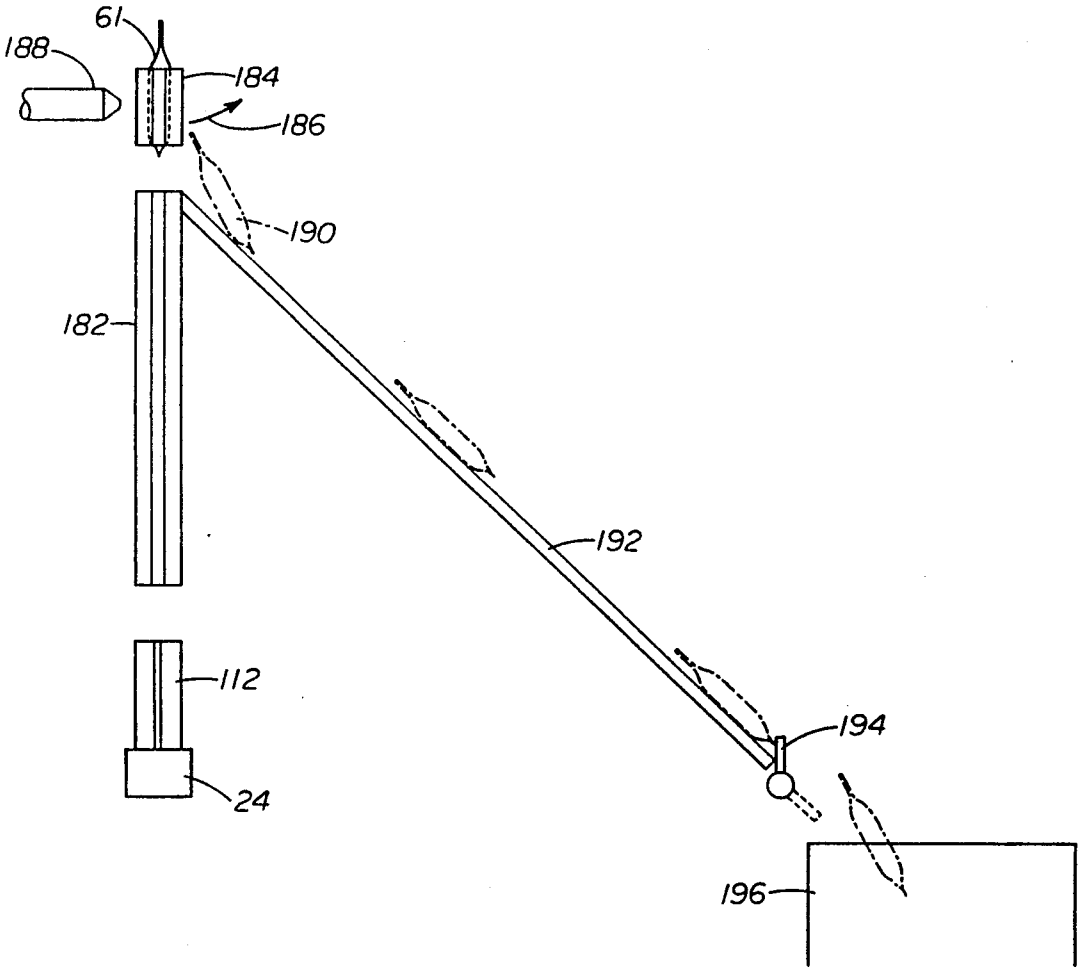
FIG. 15 is a schematic view of the package inspection chute.
Figure 14:
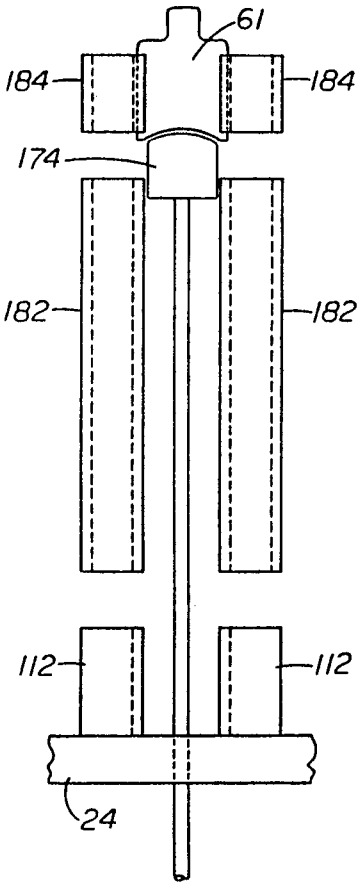
FIG. 14 is a schematic view of the package elevating track.

With the completion of the top sealing the ejector 174 continues its ascent fully ejecting the sealed package 61 from the fixtures 112. The package 61 is pushed up into a vertical track 182 in the unloading station 34 as shown in FIG. 14. The package 61 continues up the track 182 into the rotatable tracks 184 as shown. As the ejector 174 begins its descent, the rotatable tracks tilt as indicated by arrow 186 in FIG. 15 and with a nudge from an air nozzle 188 the package 61 begins its descent as indicated at 190. The package 61 slides down a chute 192 and queues against a rotatable stop 194 for easy visual inspection before release into a carton 196. In the prototype embodiment of this machine the seven chutes can be easily watched by the machine operator and packages visually checked.

The arm 24 indexes with empty fixtures 112 into station 38 wherein sensors similar to those at station 36 check for packages not ejected at station 30. In the event a package has not been ejected the indexing of the packaging machine is halted to provide access for the operator to remove the package and restart the machine.

I claim:

1. A package forming and filling machine having a plurality of stations comprising, a plurality of movable arms, the arms indexably movable from station to station, a plurality of package retaining fixtures on each arm, at least one package forming apparatus at a first station and comprising a fixed die having a cavity therethrough, a pair of opposed package forming mandrels, means for reciprocating said mandrels through the cavity, a plurality of apertures in the die, heat sealing means, and means for inserting said heat sealing means through the apertures to seal a portion of a newly formed package residing in the die, the pair of opposed package forming mandrels further reciprocable into the package retaining fixture indexed below the die to deposit a package therein, at least one filling apparatus at a second station and comprising means to expel product into an open top package residing in the package retaining fixture indexed below the filling apparatus, at least one top sealing apparatus at a third station and comprising top sealing means adapted to heat seal the top of a package at least partially residing in the package retaining fixture indexed below the top sealing means, and means to eject a filled and sealed package from the package retaining fixture.

2. The package forming and filling machine of claim 1 wherein the movable arms and package retaining fixtures on the arms, having packages deposited therein at station one, retain the packages therein through station two and through the top heat sealing step of station three.

3. The package forming and filling machine of claim 2 including means to indexably move the arms through stations one, two and three in a single horizontal plane.

4. The package forming and filling machine of claim 1 wherein the apertures in the die comprise vertical slots formed in sides of the die.

5. The package forming and filling machine of claim 4 wherein the heat sealing means comprise vertical hot elements springs and actuation means, the vertical hot elements being mounted on this actuation means by the springs.

6. The package forming and filling machine or claim 1 including means to cause the pair of opposed package forming mandrels to entrap a package blank therebetween above the die cavity before reciprocating together into the die cavity.

7. The package forming and filling machine of claim 6 including means to cause the reciprocating pair of mandrels to hesitate with the package in the die cavity aligned with the apertures for sealing a portion of a package before proceeding through and out of the die cavity.

8. The package forming and filling machine of claim 1 including means at station three to partially raise a package from the package retaining fixture to expose a package tap for top sealing.

9. The package forming and filling machine of claim 8 wherein the means to partially raise a package comprises the means to eject a filled and sealed package.

10. The package forming and filling machine of claim 9 including track means to guide a package ejected from the package retaining fixture through an inspection station.

11. The package forming and filling machine of claim 1 including package blank feeding means comprising vacuum means to sequentially retrieve package blanks, means to imprint the individual blanks sequentially and means to sequentially place the package blanks spaced above the die cavity at the first station.

12. The package forming and filling machine of claim 1 wherein said filling apparatus comprises a dosing pump and tubular product conveying means all simply connected to convey product to the package and to permit disassembly for cleaning and reassembly of all product contacting elements without tools.

13. A package forming and filling machine having a plurality of stations comprising, a plurality of moveable arms, the arms indexably moveable from station to station, a plurality of package retaining fixtures on each arm, at least one package forming apparatus at a first station and comprising a fixed die having a cavity therethrough, a pair of opposed package forming mandrels, means for reciprocating said mandrels through the cavity, means in the die to permit heat sealing a portion of the package, heat sealing means, means for inserting the heat sealing means into the die to seal a portion of a newly formed package in the die, the pair of opposed package forming mandrels further reciprocable into the package retaining fixture indexed below the die to deposit a package therein, at least one filling apparatus at a second station and comprising means to expel product into an open top package residing in the package retaining fixture indexed below the filling apparatus, at least one top sealing apparatus at a third station and comprising top sealing means adapted to heat seal the top of a package at least partially residing in the package retaining fixture indexed below the top sealing means, wherein the moveable arms and package retaining fixtures on the arms, having packages deposited therein at station one, retain the packages therein through station two and through the top heat sealing step of station three, and means to eject a filled and sealed package from the package retaining fixture.

14. The package forming and filling machine of claim 13 including means to indexably move the arms through stations one, two and three in a single horizontal plane.

15. The package forming and filling machine of claim 13 including means to cause the pair of package forming mandrels to entrap a package blank therebetween above the die cavity before reciprocating together into the die cavity.

16. The package forming and filling machine of claim 13 including means at station three to partially raise a package from the package retaining fixture to expose a package top for top sealing and upon completion of top sealing further raise the package to eject the package from the retaining fixture.

17. The package forming and filling machine of claim 13 wherein said filling apparatus comprises a dosing pump and tubular product conveying means all simply connected to convey product to the package and to permit disassembly for cleaning and reassembly of all product contacting elements without tools.

18. A method of forming and filling packages comprising the steps of:

placing a package blank in a tray spaced above a fixed die cavity, said die cavity having a plurality of apertures, entrapping the center of the package blank between upper and lower reciprocable mandrels, reciprocating the mandrels into the die cavity thereby drawing the package blank down into the die cavity, momentarily hesitating the downward motion of the mandrels with the package blank folded within the die cavity, reciprocating heat sealing means into the apertures thereby heat sealing a portion of the folded package blank together within the die cavity during the moment of hesitation to form an open top package, resuming the downward motion of the mandrels to remove the package from the die cavity and place the package in a fixture, withdrawing the mandrels from the package, moving the fixture and package to a filling station and dosing the package with product, the package remaining in the fixture, moving the fixture and package to a top sealing station, heat sealing the package top and ejecting the sealed package from the fixture.

19. The method of forming and filling packages of claim 18 including the step of elevating the package within the fixture just prior to heat sealing the top to fully expose the top for heat sealing.

20. The method of forming and filling packages of claim 18 including the step of ejecting the package into an inspection track.

* * * * *